US007490495B2

(12) United States Patent
Kim

(10) Patent No.: US 7,490,495 B2
(45) **Date of Patent: *Feb. 17, 2009**

(54) DRUM WASHING MACHINE WITH AUTOMATICALLY VERTICALLY-OPENABLE/CLOSABLE DOOR

(75) Inventor: Dong Won Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 678 days.

This patent is subject to a terminal disclaimer.

(21) Appl. No.: 11/247,282

(22) Filed: Oct. 12, 2005

(65) Prior Publication Data

US 2006/0086154 A1 Apr. 27, 2006

(30) Foreign Application Priority Data

Oct. 22, 2004 (KR) ..... 10-2004-0084901

(51) Int. Cl.
*B08B 3/00* (2006.01)
*D06F 1/00* (2006.01)

(52) U.S. Cl. ..... 68/196; 68/12.26; 68/24; 68/58; 68/140; 134/93; 134/200

(58) Field of Classification Search ..... 68/12.26, 68/23.1, 23.2, 24, 26, 58, 139, 140, 196, 68/210; 134/93, 200
See application file for complete search history.

(56) References Cited

U.S. PATENT DOCUMENTS 2,639,601 A * 5/1953 Miller ..... 68/139
2,960,780 A * 11/1960 Stilwell, Jr. ..... 38/2
5,253,433 A * 10/1993 Frey ..... 34/603
5,548,978 A * 8/1996 Bongini et al. ..... 68/17 R
5,570,597 A * 11/1996 Bongini et al. ..... 68/17 R
6,237,374 B1 * 5/2001 Malchow et al. ..... 68/139
7,350,528 B2 * 4/2008 Brunswick ..... 134/135
2005/0056059 A1 * 3/2005 Usherovich et al. ..... 68/12.02
2006/0086151 A1 * 4/2006 Kim et al. ..... 68/196
2006/0086152 A1 * 4/2006 Kim et al. ..... 68/196
2006/0086155 A1 * 4/2006 Kim et al. ..... 68/196

FOREIGN PATENT DOCUMENTS

DE 20119100 5/2002
EP 1333118 8/2003

(Continued)

OTHER PUBLICATIONS

U.S. Appl. No. 11/247,223 to Kim et al., which was filed on Oct. 12, 2005.

(Continued)

*Primary Examiner*—Michael Barr
*Assistant Examiner*—Rita R Patel
(74) *Attorney, Agent, or Firm*—Greenblum & Bernstein, P.L.C.

(57) ABSTRACT

A drum washing machine includes a cabinet with an opening formed at a front wall of the cabinet to allow laundry to be put into or taken out of the cabinet, a door to open or close the opening of the cabinet, an opening/closing guide mechanism connected between the cabinet and the door to guide the door downwardly when opening the door such that a front surface of the door is directed upwardly when the door is fully opened, and to guide the door upwardly when closing the door, and an automatic opening/closing mechanism to automatically move the door vertically, and thus, to automatically open/close the door.

30 Claims, 18 Drawing Sheets

FOREIGN PATENT DOCUMENTS

| | | |
|---|---|---|
| EP | 1365056 | 11/2003 |
| EP | 1367169 | 12/2003 |
| EP | 1389643 | 2/2004 |
| WO | 02/12613 | 2/2002 |

OTHER PUBLICATIONS

U.S. Appl. No. 11/247,275 to Kim et al., which was filed on Oct. 12, 2005.

U.S. Appl. No. 11/247,270 to Kim et al., which was filed on Oct. 12, 2005.

U.S. Appl. No. 11/247,206 to Kim et al., which was filed on Oct. 12, 2005.

U.S. Appl. No. 11/247,359 to Kim et al., which was filed on Oct. 12, 2005.

* cited by examiner

DRUM WASHING MACHINE WITH AUTOMATICALLY VERTICALLY-OPENABLE/CLOSABLE DOOR

CROSS REFERENCE TO PRIORITY DOCUMENT

This application claims the benefit of priority to Korean Patent Application No. 2004-0084901, filed in the Korean Patent Office on Oct. 22, 2004, and which is incorporated herein by reference in its entirety.

BACKGROUND OF THE INVENTION

1. Field of the Invention

The present invention relates to a drum washing machine which includes an automatically vertically-openable/closable door usable as a laundry holder when downwardly opened.

2. Description of the Related Art

Referring to FIG. 1, for example, a conventional drum washing machine is illustrated which includes a cabinet 1, in which a tub and a drum are installed extending horizontally. An opening 3 is formed at a front wall of the cabinet 1 to communicate with the tub and drum. A door 5 is mounted to the cabinet 1 to open and close the opening 3.

The door 5 is hingably mounted, at one side thereof, to a portion of the cabinet 1 corresponding to one side of the opening 3 by a hinge mechanism 7. A handle (not shown) is provided at the other side of the door 5. In accordance with this structure, the door 5 is hingably movable when the user pulls the handle to open the opening 3 or pushes the handle to close the opening 3.

The door 5 includes an annular door rim 5*a*, and a door window 5*b* surrounded by the annular door rim 5*a*. The door window 5*b* is made of a transparent glass material, and has a convex structure protruding into the interior of the conventional drum washing machine to come into contact with a gasket 9 mounted in the cabinet 1.

However, the above-mentioned conventional drum washing machine has a deficiency because the door 5 cannot be fully opened where the conventional drum washing machine 1 is installed close to a wall W, as shown in FIG. 2, for example, because the door 5 is horizontally hingably opened. When the door 5 is partially opened, for example, the convex door window 5*b* is positioned toward the opening 3, so that there may be an inconvenience because the convex door window 5*b* may interfere with laundry when the laundry is put into or taken out of the conventional drum washing machine 1 through the opening 3.

After completion of a laundry washing cycle, the user typically takes the laundry out of the conventional drum washing machine. When taking the laundry out of the conventional drum washing machine, however, the user may drop the laundry to the floor because the laundry is entangled condition. Such a situation occurs frequently. Therefore, there is a problem because the dropped laundry must be washed again.

Also, the user typically takes the laundry, piece by piece, out of the conventional drum washing machine, and shakes the laundry taken out of the conventional drum washing machine to separate foreign matter, for example, lint which clings to the laundry. After shaking one item of laundry, the user puts the shaken item of laundry into a separate laundry holder (for example, a laundry basket), and then shakes another item of laundry. The necessity of having to use the separate laundry basket may cause the user inconvenience when taking the laundry out of the conventional drum washing machine.

SUMMARY OF THE INVENTION

The present invention has been made in view of the above-mentioned problems, and it is an object of the present invention to provide a drum washing machine which includes an automatically vertically-openable/closable door movable between an open position and a closed position along a substantially vertical path, and usable as a laundry holder when open, thereby being capable of facilitating the opening of the door and loading and/or unloading the laundry even where the drum washing machine is installed in a limited space, and thus, improving the convenience of the drum washing machine for the user.

It is another object of the present invention to provide a drum washing machine which includes an automatically vertically-openable/closable door which is automatically openable and/or closable, using a linear member connected to the door to be operated by a motor, thereby being capable of achieving a more convenient door opening and/or closing operation.

In accordance with one aspect, the present invention provides a drum washing machine including a cabinet with an opening formed at a front wall of the cabinet to allow laundry to be put into and/or taken out of the cabinet, a door to open and/or close the opening of the cabinet, an opening/closing guide mechanism connected between the cabinet and the door to guide the door downwardly moved when opening the door such that the door is opened with a front surface of the door directed upwardly, and to guide the door upwardly when closing the door, and an automatic opening/closing mechanism to automatically move the door along a generally vertical path, and thus, to automatically open and/or close the door, in which the door is vertically openable and/or closable.

The opening/closing guide mechanism may include a vertical guide mechanism to guide an upper end of the door vertically along a front wall of the cabinet, and a door support mechanism to support the door when opening the door.

The automatic opening/closing mechanism may include an automatic opening/closing operating unit provided at an outer surface of the cabinet to generate a door opening signal and/or a door closing signal in response to an operation of a user, a rotating power generator to generate a drive power for a vertical movement of the door by an electrical power supplied in response to an operation of the automatic opening/closing operating unit, and a power transmission to transmit the drive power generated from the rotating power generator to the door for the vertical movement of the door.

The rotating power generator may include a motor installed in the cabinet to drive the power transmission, and a motor controller to control the motor in response to the operation of the automatic opening/closing operating unit.

The power transmission may include rotating members to be rotated by the rotating power generator, at least one of the rotating members being mounted to an upper or lower portion of the door, and a linear member connected to the rotating members to move linearly, the linear member having a portion connected to the door to move the door generally vertically in accordance with the linear movement of the linear member.

The rotating members may include pulleys respectively mounted to upper and lower portions of the cabinet, and the linear member may include a belt connected between the pulleys.

Alternatively, for example, the rotating members may include a winding roller mounted to the cabinet, and the linear member may include a rope connected between the winding roller and the door.

The drum washing machine may further include an elastic member arranged between the cabinet and the door such that when the drive power generated from the rotating power generator causes a rotation in a driven rotation direction, the elastic member urges the door in a direction substantially opposite to the driven rotation direction.

The elastic member may be connected to a portion of each support rod mounted to the cabinet to rotate the support rod by a resilience of the elastic member.

In accordance with another aspect, the present invention provides a drum washing machine including a cabinet with an opening formed at a front wall of the cabinet to allow laundry to be put into and/or taken out of the cabinet, a door to open and/or close the opening of the cabinet, a vertical guide mechanism connected between an upper end of the door and the cabinet to guide the upper end of the door vertically along a front wall of the cabinet when opening and/or closing the door, a door support mechanism connected between the door and the cabinet to guide a lower end of the door generally horizontally when opening and/or closing the door, and an automatic opening/closing mechanism to automatically move the door along the vertical guide mechanism in a generally vertical path, and thus, to automatically open and/or close the door, in which the door is vertically openable and/or closable.

According to another aspect of the present invention, for example, a washing machine for washing at least one item may include a cabinet having an opening provided at a front wall of the cabinet to allow the item to be put into or taken out of the cabinet, a door to open or close the opening of the cabinet, an opening/closing guide mechanism connected between the cabinet and the door to guide the door downwardly when opening the door such that a front surface of the door is upwardly directed when the door is fully opened, and to guide the door upwardly when closing the door, and an automatic opening/closing mechanism to automatically move at least one end of the door along a generally vertical path, in which the door is generally vertically openable or closable.

In addition, according to another aspect of the present invention, for example, a vertically openable door for opening or closing an opening provided at a front wall of a cabinet may include an opening/closing guide mechanism connected between the cabinet and the door to guide the door downwardly when opening the door such that a front surface of the door is upwardly directed when the door is fully opened, and to guide the door upwardly when closing the door, and an automatic opening/closing mechanism to automatically move the door along a generally vertical path.

Furthermore, the automatic opening/closing mechanism of the washing machine or vertically openable door may further include an automatic opening/closing operating unit disposed on an outer surface of the cabinet to generate a door opening signal or a door closing signal in response to an actuation of the automatic opening/closing operating unit by a user, a rotating power generator to generate a drive power for a vertical movement of the door by an electrical power supplied in response to the actuation of the automatic opening/closing operating unit, and a power transmission to transmit the drive power generated by the rotating power generator to the door for the vertical movement of the door. Also, the washing machine or vertically openable door may include a vertical guide mechanism to guide an upper end of the door vertically along a front wall of the cabinet, and a door support mechanism to support the door when opening the door.

According to another aspect of the present invention, for example, a washing machine for washing at least one item may include a cabinet having an opening provided at a front wall of the cabinet to allow the item to be put into or taken out of the cabinet, a door to open or close the opening of the cabinet, a vertical guide mechanism connected between an upper end of the door and the cabinet to guide the upper end of the door vertically along a front wall of the cabinet when opening or closing the door, a door support mechanism connected between the door and the cabinet to guide a lower end of the door generally horizontally when opening or closing the door, and an automatic opening/closing mechanism to automatically move at least one end of the door along the vertical guide mechanism along a generally vertical path, in which the door is generally vertically openable or closable.

In addition, according to another aspect of the present invention, for example, a vertically openable door for opening or closing an opening provided at a front wall of a cabinet may include a vertical guide mechanism connected between an upper end of the door and the cabinet to guide the upper end of the door vertically along a front wall of the cabinet when opening or closing the door, a door support mechanism connected between the door and the cabinet to guide a lower end of the door generally horizontally when opening or closing the door, and an automatic opening/closing mechanism to automatically move at least one end of the door along the vertical guide mechanism along a generally vertical path, in which the door is generally vertically openable or closable.

Furthermore, the automatic opening/closing mechanism of the washing machine or vertically openable door may further include an automatic opening/closing operating unit disposed at an outer surface of the cabinet to generate a door opening signal or a door closing signal in response to an actuation of the automatic opening/closing operating unit by a user, a rotating power generator to generate a drive power for a vertical movement of the door by an electrical power supplied in response to the actuation of the automatic opening/closing operating unit, and a power transmission to transmit the drive power generated by the rotating power generator to the door for the vertical movement of the door.

In any of the aspects of the present invention noted above, although the washing machine or drum washing machine is exemplified to simplify discussion of certain features of the present invention, it should be understood that the present invention is not limited only to a washing machine for washing laundry, but also contemplates washing machines for washing any appropriate item, such as dishes and/or eating utensils, medical and/or scientific instruments (e.g., an autoclave), or any other item to be washed, for example. Further, the vertically openable door may also function with any sort of cabinet or other such approximately cubic container (such as a filing cabinet, computer case, clothes dresser, or coal hopper, for example), and is not necessarily limited to use with washing machines, for example.

BRIEF DESCRIPTION OF THE DRAWINGS

The above objects, and other features and advantages of the present invention will become more apparent in view of the following detailed description when taken in conjunction with the accompanying drawings, in which.

DESCRIPTION OF THE PREFERRED EMBODIMENTS

Now, exemplary embodiments of the present invention will be described in detail with reference to the accompanying drawings. Although several examples of various embodiments are described and taught, each example described below is understood to be only one possible implementation among many which may conform to the present invention, and no such example should be interpreted to impart any limitation to the present invention.

Figure 1:
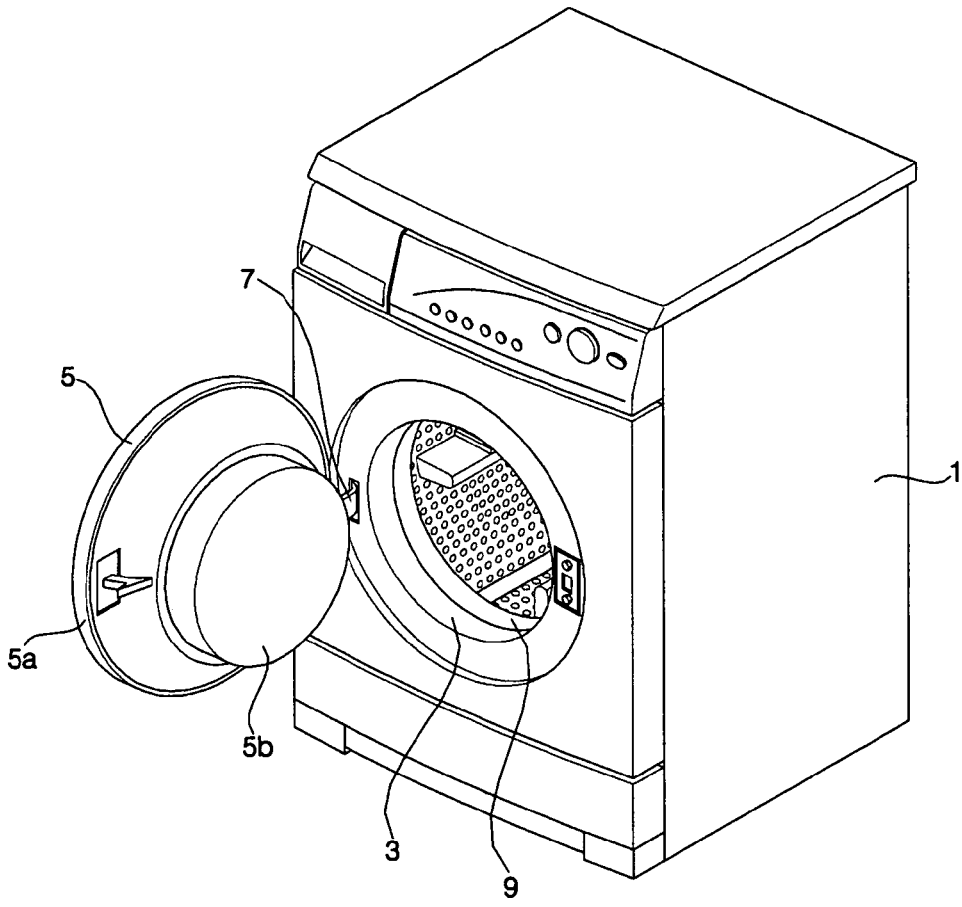
FIG. 1 (Prior Art)
FIG. 1 is a perspective view illustrating a conventional drum washing machine.
Figure 2:
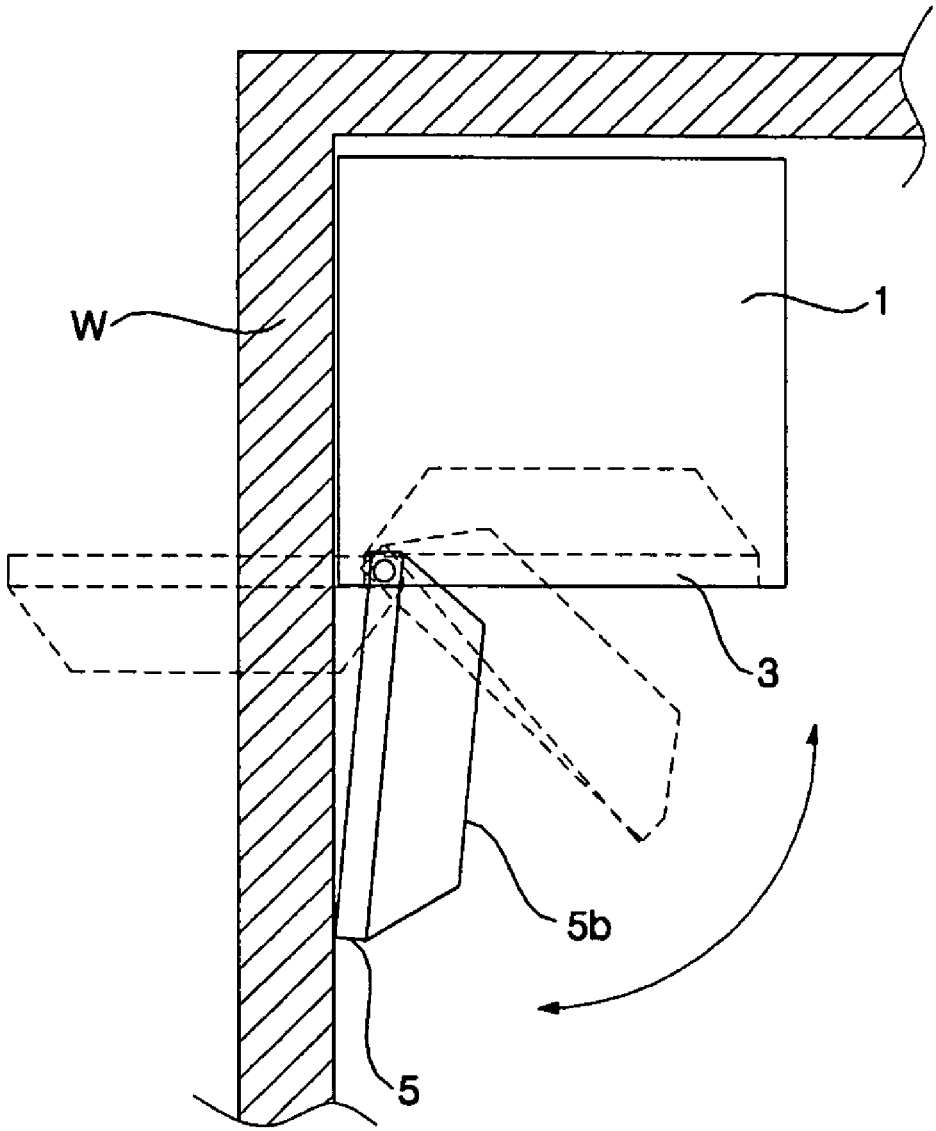
FIG. 2 (Prior Art)
FIG. 2 is a schematic view illustrating a conventional drum washing machine with an open door.
Figure 3:
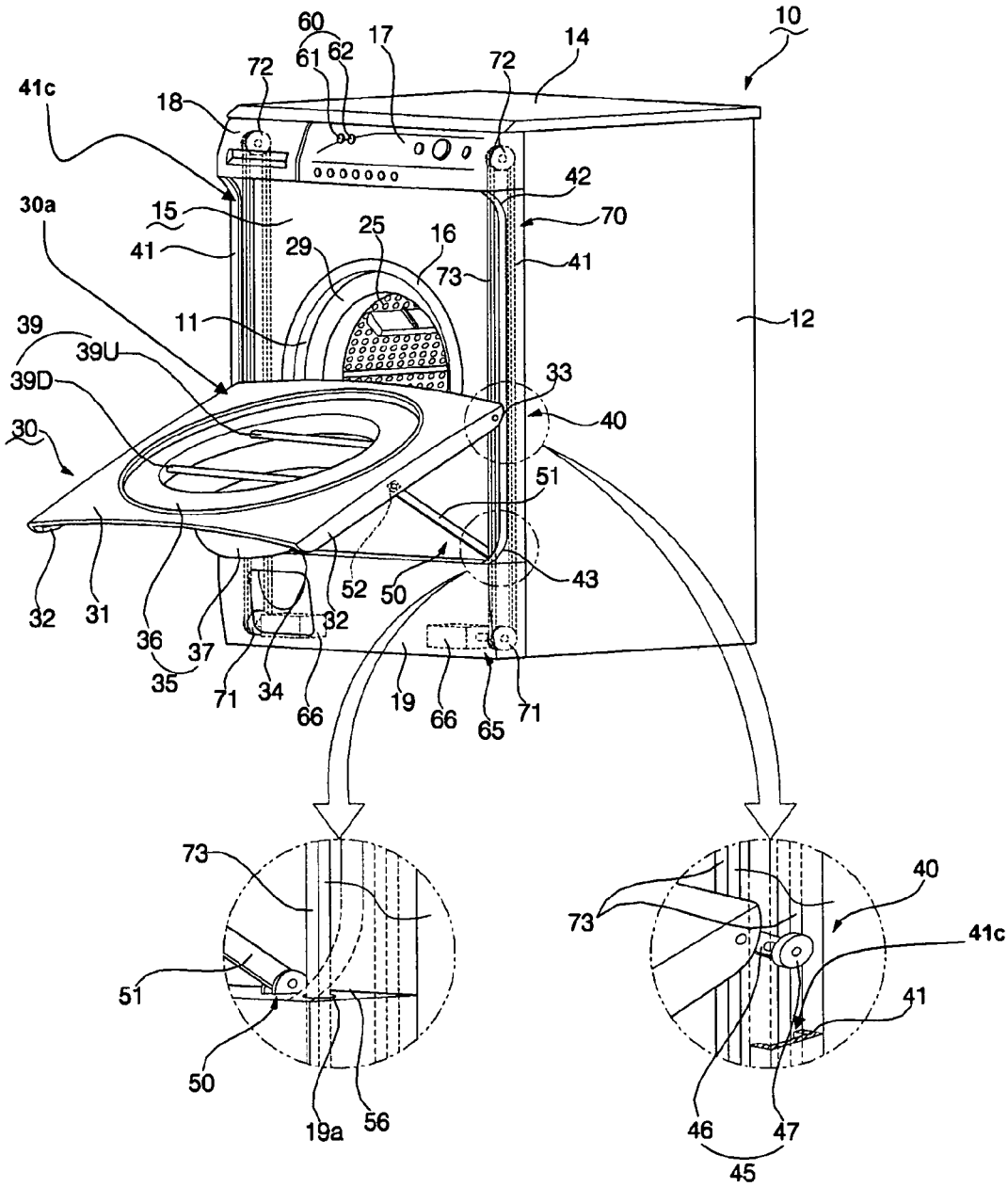
FIG. 3 is a perspective view illustrating a drum washing machine according to a first embodiment of the present invention, together with enlarged views of portions of the drum washing machine.
Figure 4:
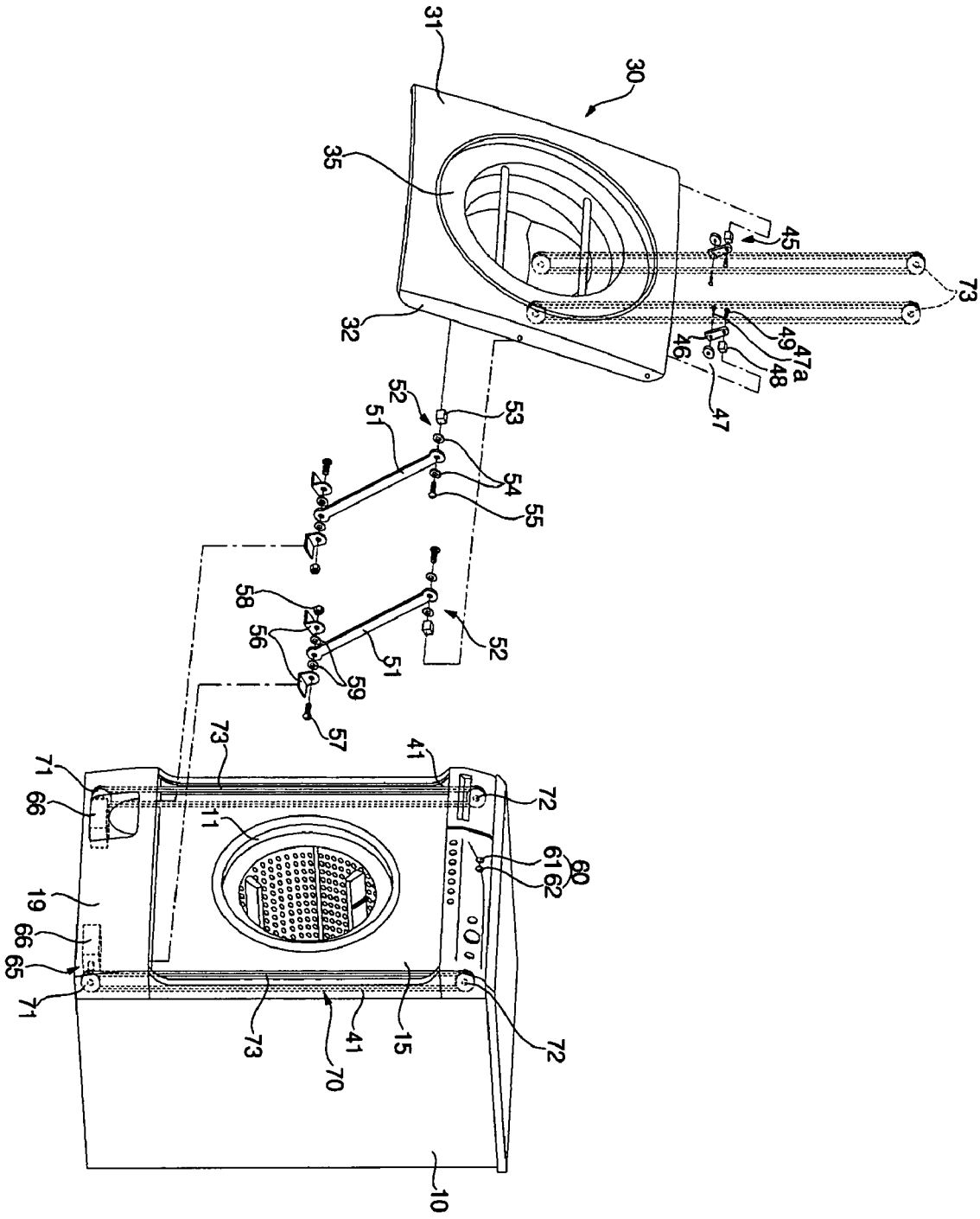
FIG. 4 is an exploded perspective view illustrating the drum washing machine according to the first embodiment of the present invention, in which a vertically-openable/closable door is separated from the drum washing machine.

FIGS. 3 through 6 illustrate a drum washing machine according to a first embodiment of the present invention, for example. Referring to FIGS. 3 and 4, the drum washing machine, which is provided with an automatically vertically-openable/closable door may include a cabinet 10 to form an outer structure of the drum washing machine. An opening 11 may be provided at a front wall of the cabinet 10 to allow laundry (not shown) to be put into or taken out of the drum washing machine.

Figure 5:
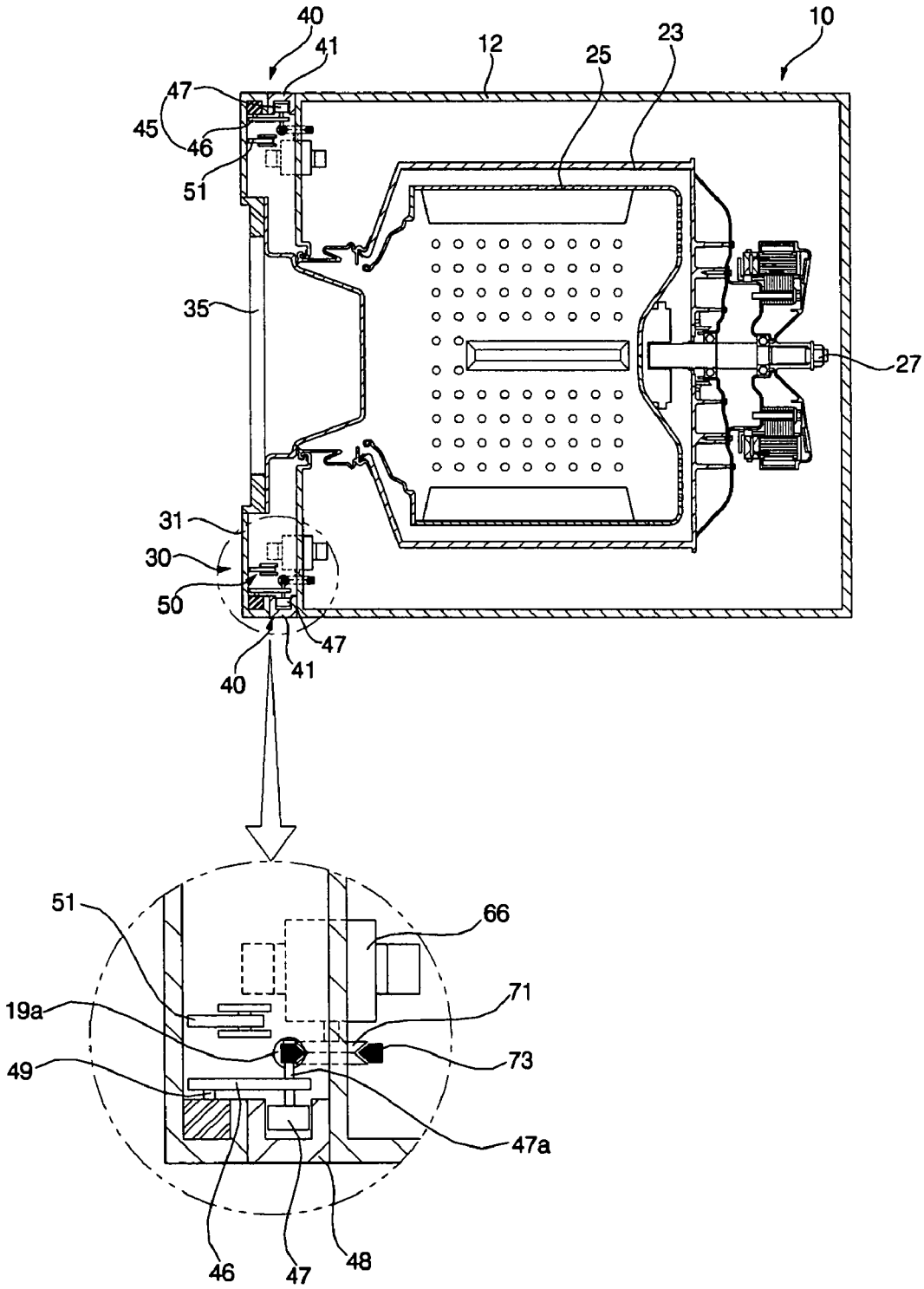
FIG. 5 is a transverse sectional view illustrating the drum washing machine according to the first embodiment of the present invention.
Figure 6:
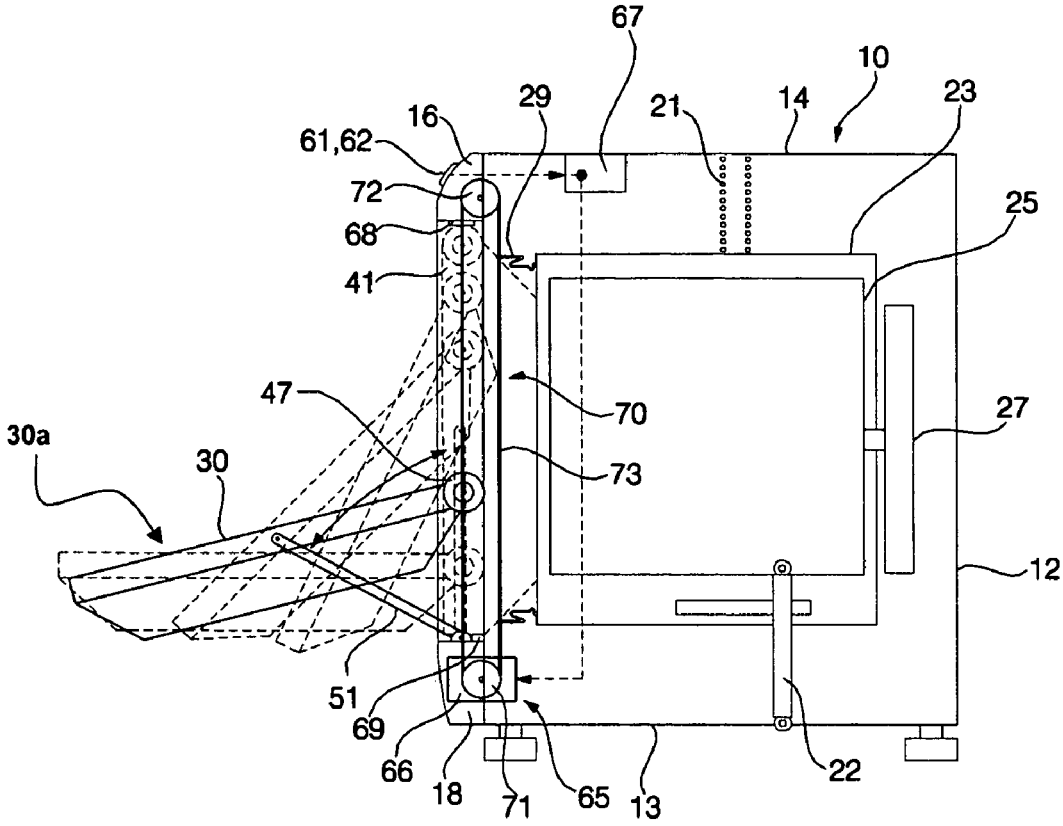
FIG. 6 is a schematic side view illustrating the drum washing machine according to the first embodiment of the present invention with a door opened.

Devices to perform a washing operation may be installed in the cabinet 10. For example, as shown in FIGS. 5 and 6, the drum washing machine may include a tub 23 supported by a spring 21 and a damper 22 in the cabinet 10 to contain washing water, a drum 25 arranged in the tub 23 to wash laundry while rotating, and a drive motor 27 to rotate the drum 25.

The opening 11 of the cabinet 10 may communicate with respective openings of the tub 23 and drum 25 to allow laundry to be put into or taken out of the drum 25. A gasket 29 may be interposed between the openings of the cabinet 10 and tub 23 to prevent washing water or the like from penetrating the interior of the cabinet 10 when washing laundry.

The cabinet 10 may have a substantially hexahedral structure, for example. As illustrated in FIGS. 3 and 4, for example, the cabinet 10 may include a cabinet body 12 to form side walls and a rear wall of the cabinet 10, a base 13 to form a bottom wall of the cabinet 10, a top cover 14 to form a top wall of the cabinet 10, and a front cover 15 to form a front wall of the cabinet 10. The opening 11 may be formed at the front cover 15.

A control panel 17 may be arranged on a top portion of the front cover 15. The control panel 17 may include various operating switches (or other control devices suitable for a user to manipulate, such as a touch-sensitive screen, for example) to operate the drum washing machine, and a display device to display, for example, an operating state (such as water temperature, time elapsed since start of wash cycle, and/or other salient information) of the drum washing machine. As an alternative, the control panel 17 may be arranged at a position other than the above-described top portion of the front cover 15; for example, the control panel 17 may be arranged on the top wall of the cabinet 10, such as on the top cover 14.

The control panel 17 may also include an automatic door opening button 61 and an automatic door closing button 62 to operate the door 30 to be automatically opened and/or closed.

A slidable detergent box 18 to supply detergent may be arranged at one side of the control panel 17.

A lower cover 19 may be coupled to the cabinet body 12 and base 13 to form a lower portion of the front cover 15.

For example, a door 30 may be mounted to the outer surface of the front cover 15 to open and/or close the opening 11. The front cover 15 may be coupled with the cabinet body 12, control panel 17 and/or lower cover 19 while being recessed into the cabinet 10 with respect to the control panel 17 and lower cover 19, so that the outer surface of the front cover 15 is flush with respective outer surfaces of the control panel 17 and lower cover 19 when the door 30 is closed.

An annular opening rim 16 may be provided at a central portion of the front cover 15 to define the opening 11. The gasket 29 may be fitted in the opening rim 16. The opening rim 16 may be formed integrally with the front cover 15 by bending a portion of the front cover 15 around the opening 11, for example. Alternatively, for example, the opening rim 16 may be a separate ring-shaped member that can be fitted around the opening 11.

The door 30 may have a substantially quadrangular shape similar to the shape of the front cover 15. For example, the door 30 may have a generally quadrangular planar and/or plate-like structure and may include a door frame 31 having a shape conforming to the shape of the outer surface of the front cover 15, and a container-shaped door window 35 having a convex structure to protrude into the opening 11 of the cabinet 10 when the door 30 is closed, such that the container-shaped door window 35 comes into close contact with the gasket 29.

The door frame 31 may have opposite side portions 32 each formed by bending a corresponding side end portion of the door frame 31 into a shape generally similar to a letter "L". The side portions 32 typically form opposite side walls of the door 30, respectively. Each side portion 32 may include, at upper and lower ends thereof, round surfaces 33 and 34 to prevent the side portion 32 from interfering with the lower cover 19 and vertical guides 41 when opening and/or closing the door 30.

The container-shaped door window 35 may have a container structure to come into contact with the gasket 29 when the door 30 is closed and to receive laundry when the door 30 is open. The container-shaped door window 35 may include an annular window rim 36 mounted to the door frame 31, and a container-shaped window 37 having a concave container structure to receive laundry. The container-shaped window 37 may be fitted in the window rim 36.

The window rim 36 may be made of a metal or synthetic resin material, for example, or any other suitable material for such a purpose. Also, the container-shaped window 37 may be made of a transparent or translucent material (such as glass, plastic, carbon fiber or the like) to allow the user to view the interior of the drum 25 through the container-shaped window 37.

A handle 39 may be provided at the door 30 to allow the user to manually open and/or close the door 30 while grasping the handle 39. As illustrated in FIG. 3, for example, two handles 39U and 39D may be arranged on the door 30 spaced vertically apart from each other.

The door 30 may be movable vertically such that the door can be opened downwardly and/or closed upwardly. When the door 30 is opened, for example, the outer surface 30*a* of the door 30 may face upwardly so that when taking laundry out of the drum 25, the laundry taken out of the drum 25 may be temporarily stored in the door 30.

For such an opening and/or closing operation of the door 30, an opening/closing guide mechanism may be arranged between the front cover 15 of the cabinet 10 and the door 30 at opposite sides of the door 30, for example. The opening/closing guide mechanism may include a vertical guide mechanism 40 to guide an upper end of the door 30 generally vertically along the outer surface of the front cover 15, and a door support mechanism 50 to support the door 30 when opening the door 30 such that the door 30 is gradually opened toward a horizontal alignment and is maintained substantially horizontally when the door 30 is completely opened.

The vertical guide mechanism 40 may include two vertical guides 41 mounted to opposite side ends of the outer surface of the front cover 15 and extending vertically, respectively, and two pairs of guide couplers 45 each protruding from the door 30 to move vertically along an associated one of the vertical guides 41, for example.

Each vertical guide 41 may be formed, at an inner surface thereof, with a "U"-shaped guide groove 41*c* (as shown in FIG. 3, for example). The vertical guides 41 may be provided in the form of separate members so that they may be mounted to the opposite side ends of the front cover 15, respectively. Alternatively, for example, the vertical guides 41 may be formed integrally with the front cover 15 by bending opposite side end portions of the front cover 15 into a "U" shape, respectively. Also, each vertical guide 41 may be formed with round portions 42 and 43 respectively protruding from the upper and lower ends of the vertical guide 41 to conform to the associated round surfaces 33 and 34 of the door frame 31, and respectively joined with the lower surface of the control panel 17 and the upper surface of the lower cover 19.

It is preferable that each guide coupler 45 include a roller 47 to perform a rolling movement along the associated vertical guide 41. However, as an alternative, for example, each guide coupler 45 may include a member having a simple protrusion structure to be slidably received in the associated vertical guide 41.

The rollers 47 may be rotatably mounted to roller brackets 46 mounted to the upper end of the door frame 31. Each roller bracket 46 may be connected to a mounting nut 48 fixed to an associated one of the side portions 32 of the door frame 31 by a bracket pin 49 such that the roller bracket 46 is hingable within a hinge angle. Accordingly, as the door 30 moves vertically, for example, the roller bracket 46 hinges about the bracket pin 49, thereby enabling the associated roller 47 to move smoothly along the associated vertical guide 41.

The door support mechanism 50 may include an elongated support rod 51 rotatably connected to the cabinet 10 and door frame 31 at opposite ends of the support rod 51, respectively. The door support mechanism 50 may include two support rods 51 arranged at opposite sides of the door 30, respectively, as illustrated in FIGS. 3 and 4, for example.

Each support rod 51 may be hingably connected, at an upper end thereof, to an associated one of the side portions 32 of the door frame 31 inside the associated side portion 32 by a hinge 52. As shown in FIG. 5, for example, the connection of each support rod 51 to the door frame 31 may be achieved using elements such as a mounting nut 53 fixed to the inner surface of the associated side portion 32 of the door frame 31 by welding or other suitable joining technology (such as, for example, casting, forging, use of adhesives, or mechanical joining), washers 54 respectively arranged at opposite sides of the support rod 51, and a hinge bolt 55 extending through the washers 54 and support rod 51 to be threadedly coupled with the mounting nut 53. Each side portion 32 of the door frame 31 may be partially cut out at a region along which the associated support rod 51 moves, in order to prevent the side portion 32 from interfering with the support rod 51.

Each support rod 51 may also be hingably connected, at a lower end thereof, to a hinge bracket 56 mounted to an upper end of the lower cover 19 included in the cabinet 10. The connection between the support rod 51 and the hinge bracket 56 may be achieved using elements such as a hinge bolt 57, a nut 58, and washers 59, for example.

The drum washing machine having the above-described door opening/closing structure may also include an automatic opening/closing mechanism to automatically move the door 30 along a generally vertical path, and thus, to automatically open/close the door 30. It is noted that as used herein, moving the door along a generally vertical path refers to moving the door either upwardly and/or downwardly along the substantially vertical path (depending, for example, whether the door 30 is being opened or closed), and is not intended to be restricted only to moving the door 30 upwardly, for example.

The automatic opening/closing mechanism may include an automatic opening/closing operating unit 60 having the automatic door opening button 61 and automatic door closing button 62 and provided at the control panel 17 such that the user can directly actuate the automatic opening/closing operating unit 60, a rotating power generator 65 to generate a rotating power to move the door 30 generally vertically in accordance with actuation of the automatic opening/closing operating unit 60, and a power transmission 70 to transmit the rotating power generated by the rotating power generator 65 to the door 30 for the vertical movement of the door 30.

Although it is preferred that the automatic opening/closing operating unit 60 include both the automatic door opening button 61 and the automatic door closing button 62 as an alternative, for example, only one of the buttons 61 and 62 may be provided, if suitable. Also, although the automatic opening/closing operating unit 60 has been described above as being provided at the control panel 17 arranged on the front wall of the cabinet 10, as an alternative, the automatic opening/closing operating unit 60 may otherwise be arranged elsewhere—for example, the top wall or one side wall of the cabinet 10.

As shown in FIG. 6, for example, the rotating power generator 65 may include a motor 66 fixedly mounted on the base 13 of the cabinet 10 to drive the power transmission 70, and a motor controller 67 to control the motor 66 is turned on or off, and/or the direction in which the motor 66 is rotated in response to actuation or manipulation of the automatic opening/closing operating unit 60.

In a further example, motor controller 67 may be incorporated in a controller (not shown) which controls the entire operation of the drum washing machine. Other devices, such as a motor driving circuit (not shown) to drive the motor 66, may also be incorporated in the controller.

The motor 66 may include a bi-directional motor to generate a rotating force in either of a forward or reverse direction in accordance with operation of the motor controller 67.

Preferably, limit switches 68 and 69 may be arranged in upper and lower door paths on the front cover 15 to sense a completely-opened position and/or a completely-closed position of the door 30 and to send corresponding sensing signals to the motor controller 67 for stopping the motor 66 upon reaching one of those states, respectively. The limit switches 68 and 69 may be directly mounted to the door 30, for example.

Further, although the rotating power generator 65 has been described as including the motor 66, which is typically driven by electricity, the rotating power generator 65 is not necessarily limited to the motor 66. For example, any power generator suitable to rotate a pulley 71 or a winding roller 81, such as, for example, a pneumatic actuator (not shown) may alternatively be used as a rotating power generator 65.

The power transmission 70 may include a belt-pulley assembly including a pair of pulleys 71 and 72 as rotating members respectively mounted to the cabinet 10 inside the control panel 17 and lower cover 19 above and below the door 30, and a belt 73 as a linear member connected between the pulleys 71 and 72 and connected to the door 30 at a portion of the belt 73 such that the belt 73 travels in accordance with the rotation of the pulleys 71 and 72 to move the door 30 vertically, for example. The power transmission 70 may also include a pair of belt-pulley assemblies arranged at opposite sides of the door 30, as illustrated in FIGS. 5 and 6, for example. The rotating power generator 65 may include two motors 66 to drive the belt-pulley assemblies, respectively.

The lower one of the pulleys 71 or 72, for example, the pulley 71, may be coupled to the motor 66 to rotate in accordance with a drive force of the motor 66. The upper pulley 72 may be rotatably mounted to a bracket fixed to the cabinet 10 inside the cabinet 10. For example, the belt 73 may be connected at an appropriate portion thereof between the pulleys 71 and 72, to an associated one of the guide couplers 45, which are movable along respective vertical guides 41. Preferably, the belt 73 may be directly coupled to a shaft 47*a* of the roller 47 constituting the associated guide coupler 45, as shown in FIG. 4, for example.

The belt 73 may have outer and inner belt portions respectively arranged outside and inside an imaginary line connecting the centers of the pulleys 71 and 72. The belt 72 may be connected to the associated roller 47 at the outer belt portion, and the outer belt portion may be forwardly exposed in front of the front cover 15. The remaining portion of the belt 73 may be arranged inside the cabinet 10 behind the front cover 15. Accordingly, for example, the control panel 17 and lower cover 19, which may be arranged on the front wall of the cabinet 10, can be provided with holes to allow the belt 73 to pass therethrough. In FIG. 4, for example, only the hole 19*a* of the lower cover 19 is shown.

Although the power transmission 70 has been described above as including two belt-pulley assemblies arranged at the opposite sides of the door 30, as an alternative, for example, the power transmission 70 may also be arranged only at one side of the door 30.

Further, although the power transmission 70 has been described above as including at least one belt-pulley assembly having two pulleys 71 and 72 and one belt 73, as an alternative, for example, the power transmission 70 may also include at least one sprocket-chain assembly including two sprockets and one chain (not shown). The sprockets may correspond to the above-described pulleys 71 and 72, respectively, and the chain may correspond to the belt 73, and be connected between the sprockets, for example.

Hereinafter, an exemplary operation of the drum washing machine with the vertically-openable/closable door according to the first embodiment of the present invention will be described.

FIGS. 7A through 7E illustrate sequential door opening states of the drum washing machine according to the first embodiment of the present invention, respectively. For simplicity of description, the following description will be described assuming that only one belt-pulley assembly is used, although the present invention is not necessarily limited to such a configuration.

Figure 7A:
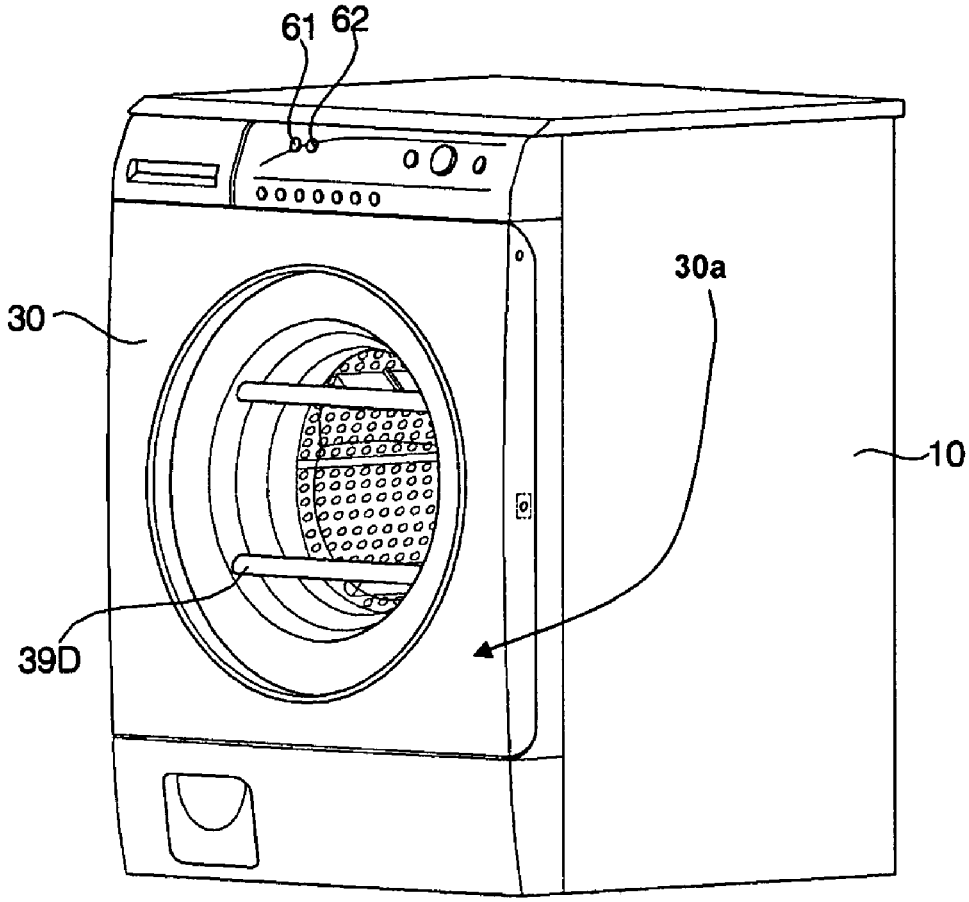
FIGS. 7A through 7E are perspective views illustrating different positions of the door of the drum washing machine according to the first embodiment of the present invention, respectively, as the door opens.
Figure 7B:
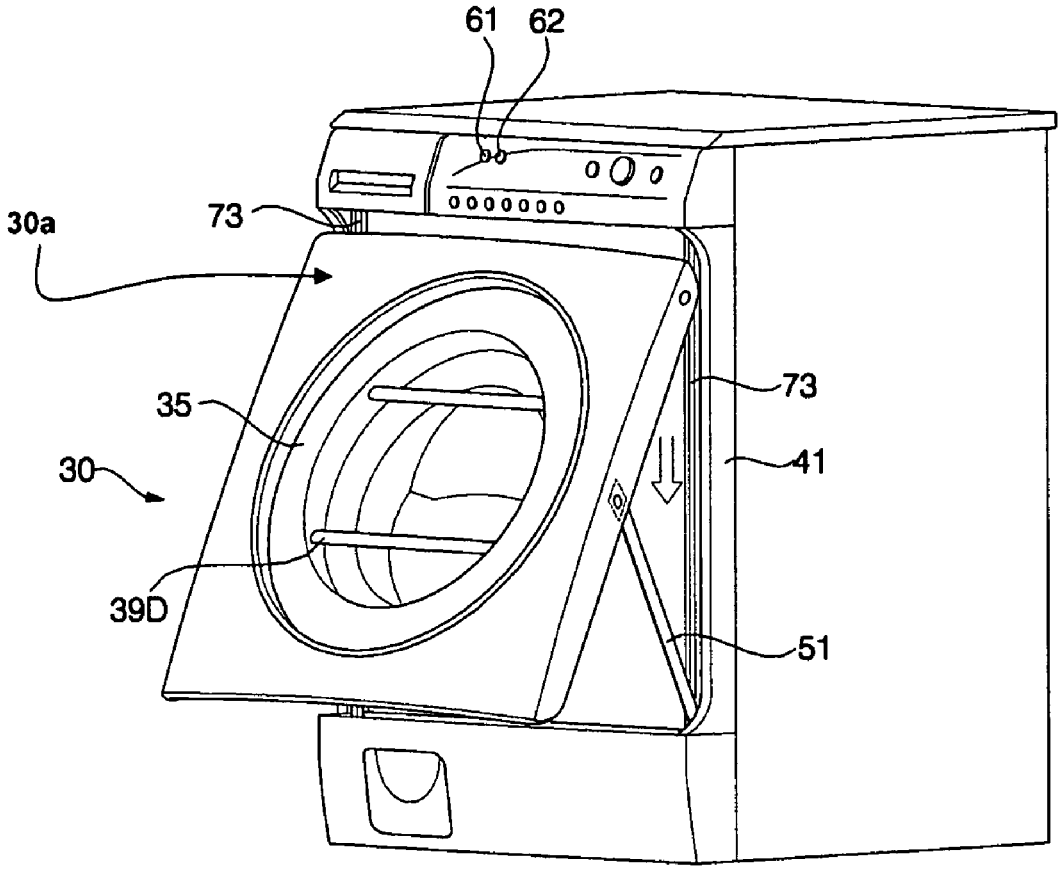
Figure 7C:
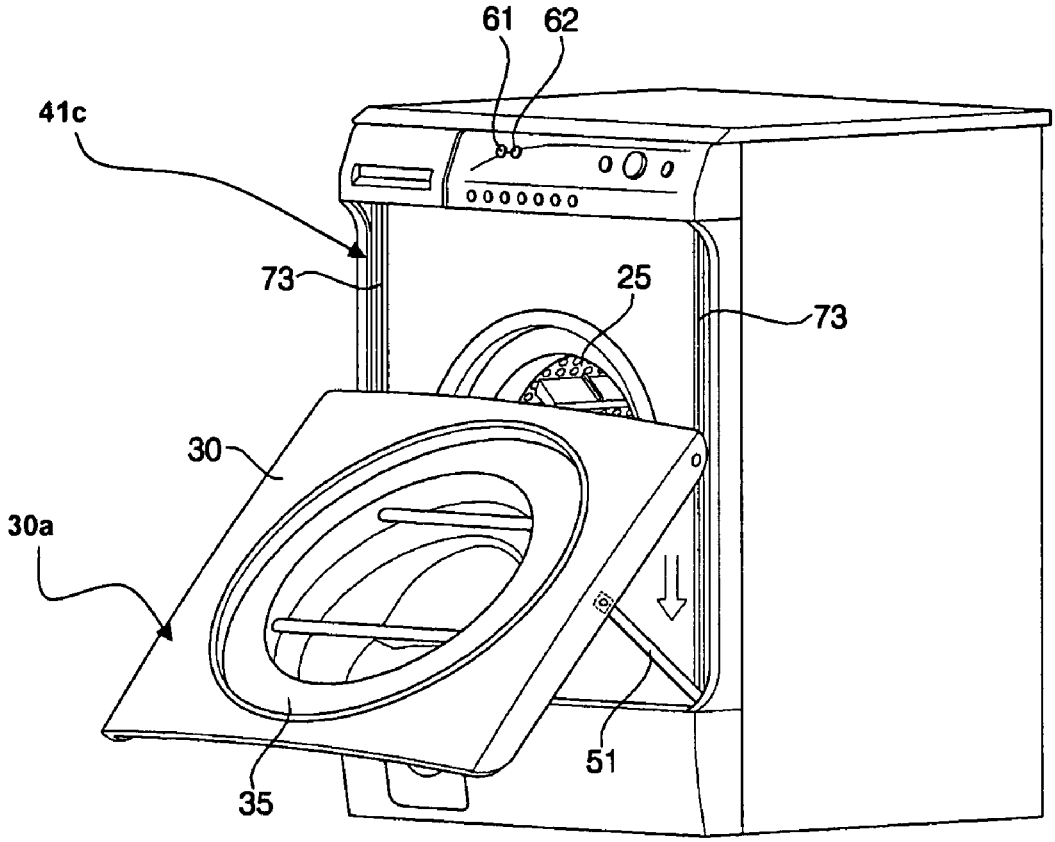
Figure 7D:
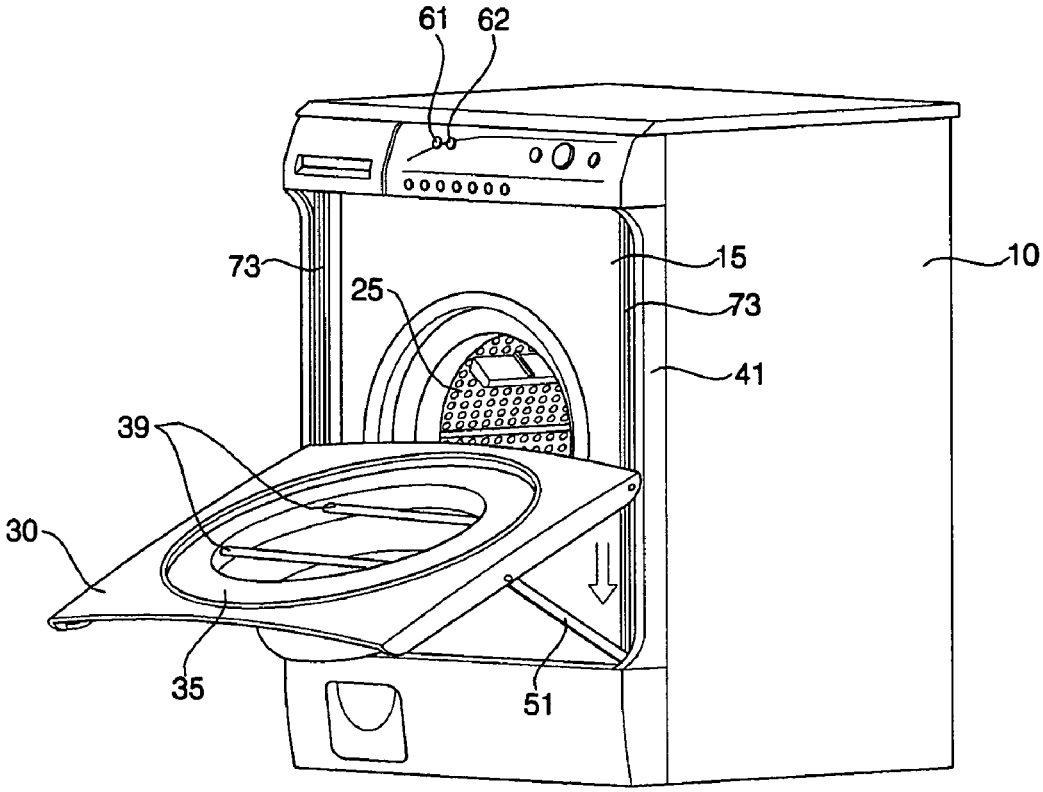
Figure 7E:
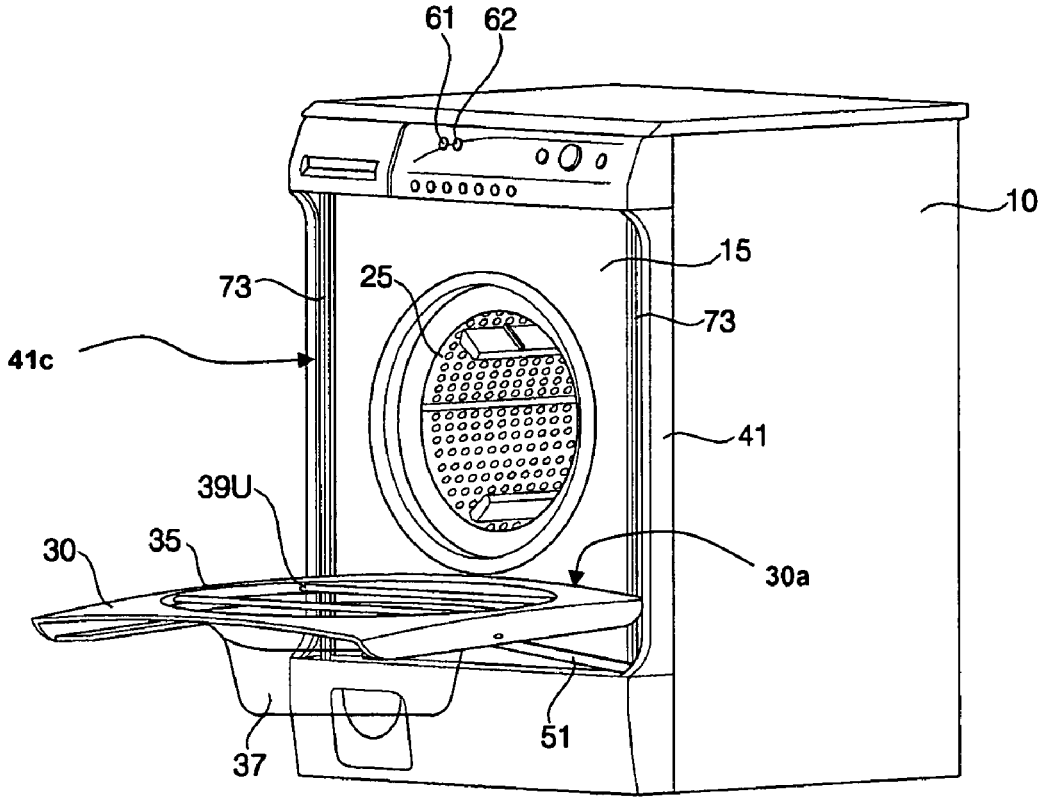

When the user actuates the automatic door opening button 61 arranged on the front wall of the cabinet 10 to automatically open the door from a closed state, for example, a corresponding signal is sent to the motor controller 67. In response to the signal, the motor controller 67 controls the motor 66 to be driven. As a result, the pulley 71 is driven, so that the belt 73 connected between the pulleys 71 and 72 proceeds along its path, thereby causing the door 30 to be opened while automatically moving downwardly, for example. Then, opening of the door 30 may proceed through of the positions shown in FIGS. 7B through 7E in such a manner that the upper end of the door 30 is moved downwardly and the lower end of the door 30 is moved horizontally away from the cabinet 10. As a result, the door 30 may be opened as shown in FIG. 7E, for example.

For example, the upper end of the door 30 moves downwardly as the rollers 47 roll downwardly along the associated vertical guides 41 in accordance with the movement of the belt 73. At that time, each support rod 51 hinges about the lower end thereof from a vertical state, in accordance with the movement of the door 30 such that the upper end of the support rod 51 moves both horizontally and downwardly to be spaced away from the front of the cabinet 10. In accordance with such movement, the support rod 51 supports the door 30 while opening the door 30 to enable the lower end of the door 30 to move horizontally.

When the door 30 is open, the user can put laundry into the drum 25 through the opening 11 of the cabinet 10, and can take laundry out of the drum 25. At that time, the user can also temporarily store the laundry, taken out of the drum 25, in the container-shaped door window 35, for example.

The laundry, which is taken out of the drum 25 when the door 30 is open, and temporarily stored in the door container-shaped window 35, is typically subsequently taken out of the container-shaped door window 35 to be transferred to another place. When the user presses the automatic door closing button 62 to close the door 30, for example, the motor 66 is reversely driven in accordance with a control signal generated from the motor controller 67 in response to the pressing of the automatic door closing button 62. As a result, the belt 73 travels in a direction opposite to the door opening direction, thereby causing the door 30 to be automatically moved upwardly, and thus, to be closed.

At that time, the rollers 47 mounted to the upper end of the door 30 roll upwardly along the associated vertical guides 41 in accordance with a procedure substantially the reverse of the above-described procedure for opening the door 30. The lower end of the door 30 is substantially horizontally moved toward the cabinet 10, and comes into contact with the front cover 15, together with the upper end of the door 30, so that the door 30 is closed.

Although the opening and closing operations of the door 30 have been described above as being automatically achieved using the automatic door opening button 61 and automatic door closing button 62, as an alternative, for example, the user can also manually open and/or close the door 30 while grasping the handle 39.

In such a case, the user can open or close the door 30 by either pulling the door 30 downwardly while grasping the lower handle 39D to open the door 30, or pulling the door 30 upwardly while grasping the upper handle 39U to close the door 30, for example.

Hereinafter, second through six embodiments of the present invention will be described.

Figure 8:
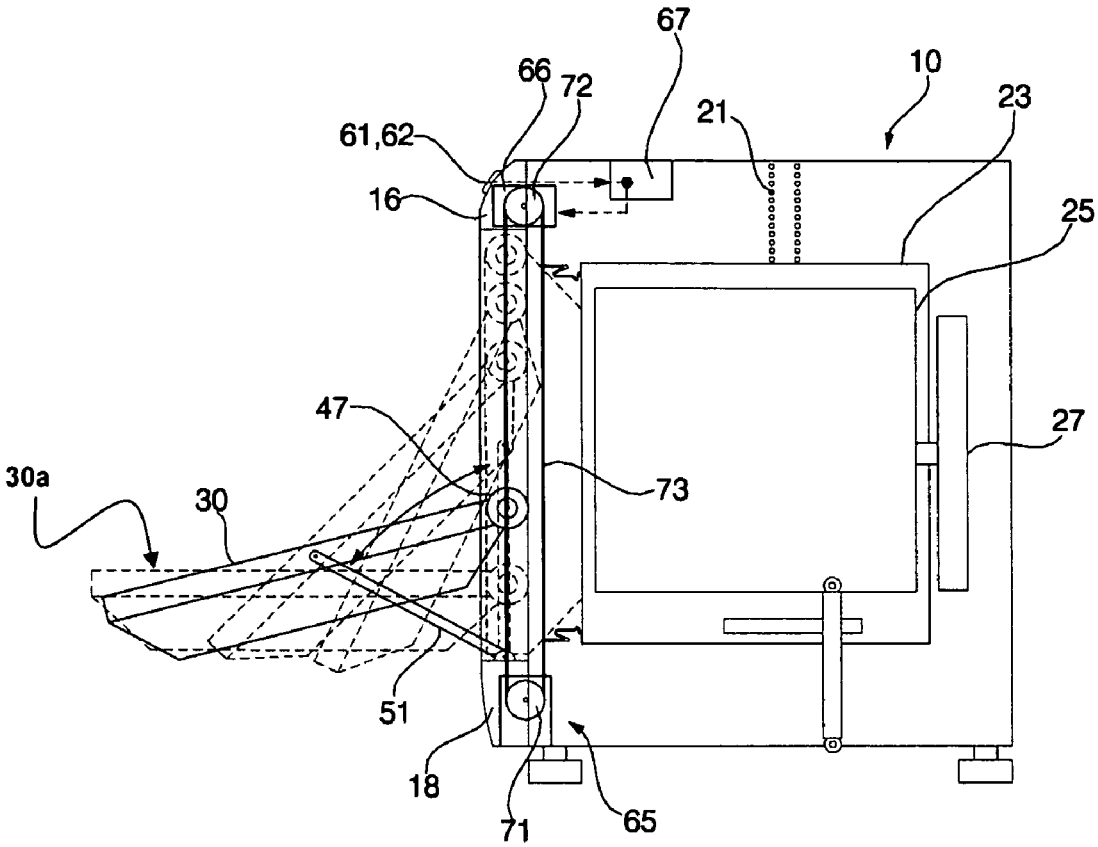
FIG. 8 is a schematic side view illustrating a drum washing machine according to a second embodiment of the present invention.

FIG. 8 illustrates a drum washing machine according to the second embodiment of the present invention, having a motor 66 mounted to the upper portion of the cabinet 10 inside the cabinet 10, in contrast to having the motor 66 mounted to the lower portion of the cabinet 10 inside the cabinet 10, as described above with reference to the first embodiment, for example.

For example, the motor 66 may be arranged behind the control panel 16. In such a case, an upper pulley 72 may be coupled to a shaft of the motor 66, and a lower pulley 71 may be arranged behind the lower cover 18. A belt 73 may be connected between the pulleys 71 and 72 to move a door 30 along a generally vertical path, which is connected to the belt 73.

Aspects of the configuration of the drum washing machine according to the second embodiment may be generally similar to those of the first embodiment as discussed above (or any other suitable embodiment), except as otherwise noted.

Figure 9:
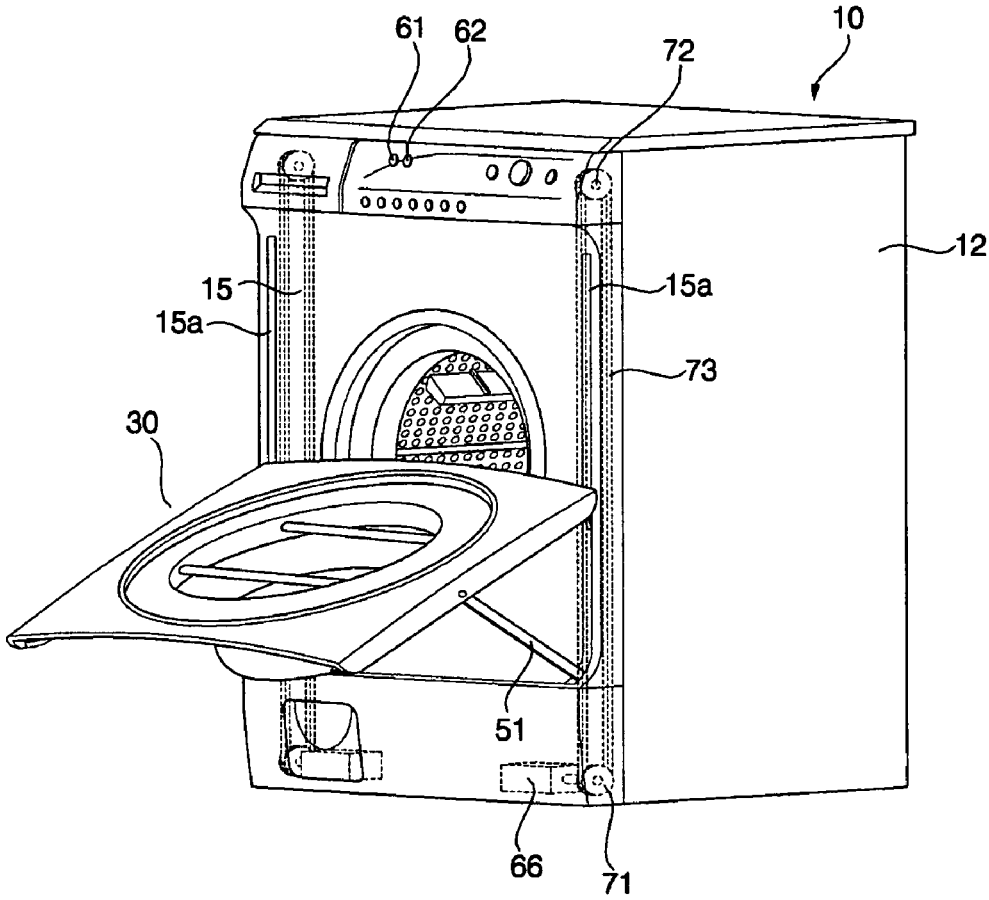
FIG. 9 is a perspective view illustrating a drum washing machine according to a third embodiment of the present invention.
Figure 10:
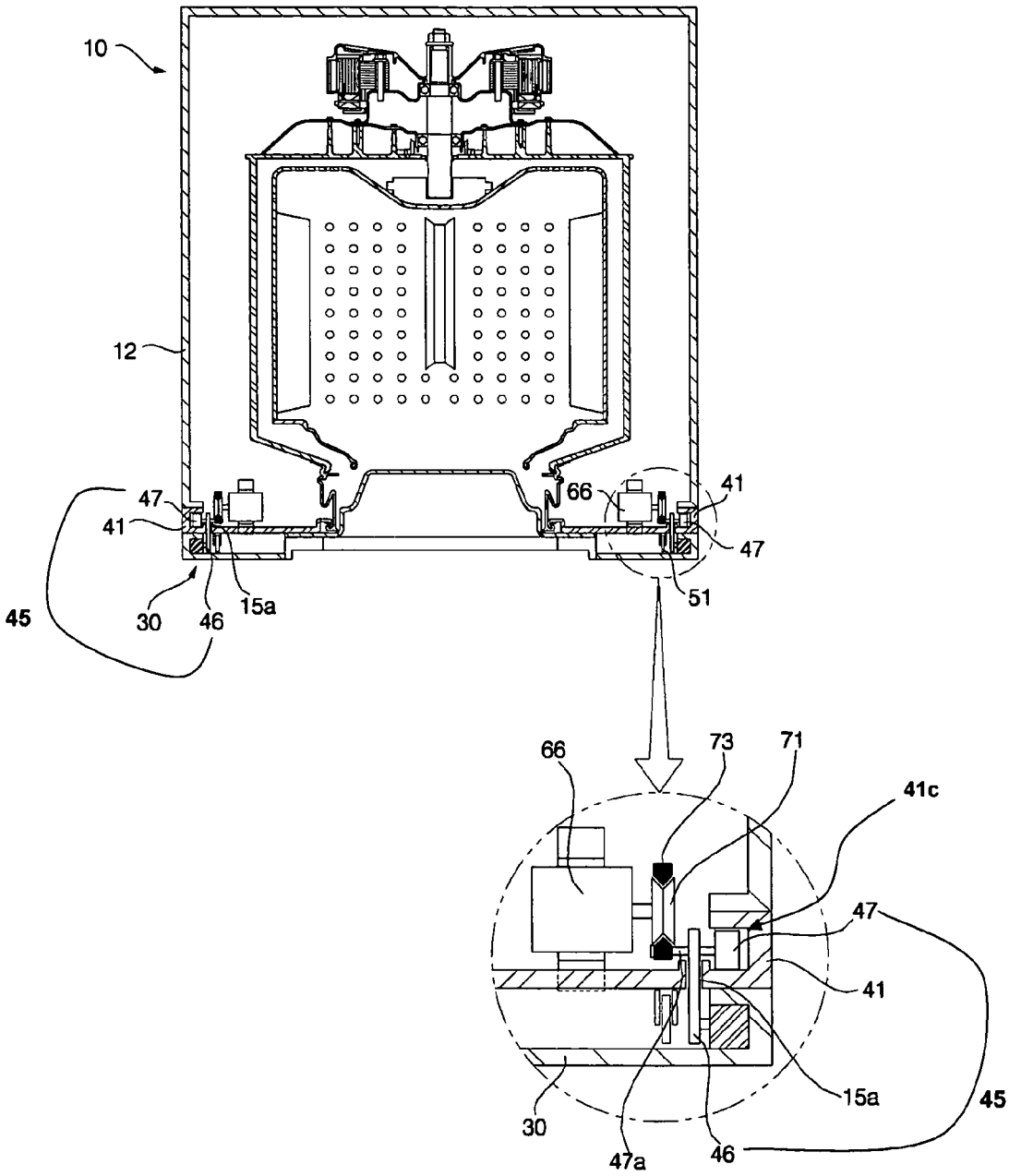
FIG. 10 is a transverse sectional view illustrating the drum washing machine according to the third embodiment of the present invention.

FIGS. 9 and 10 illustrate a drum washing machine according to a third embodiment of the present invention, in which guide couplers 45 provided at a door 30 may be received in a front cover 15 such that the guide couplers 45 are vertically movable along vertical guides 41.

For example, vertically-elongated slits 15*a* may be formed at opposite side portions of the front cover 15 to receive the guide couplers 45, while allowing the guide couplers 45 to be movable. The front cover 15 may also be provided with the vertical guides 41 behind the slits 15*a*, respectively. The vertical guides 41 may be formed by bending opposite side end portions of the front cover 15 into a "U" shape. Roller brackets 46 may be mounted to the upper end of the door 30 at opposite sides of the door 30, respectively. Each roller bracket 46 may extend through an associated one of the slits 15*a* such that the roller bracket 46 is vertically movable along the associated slit 15*a* in accordance with a vertical movement of the door 30. A roller 47 may be mounted to each roller bracket 46 such that the roller 47 rolls along an associated one of the vertical guides 41 during the vertical movement of the roller bracket 46.

Further, for example, because each guide coupler 45 may be received in the front cover 15, the roller 47 constituting the guide coupler 45 may also be arranged inside the cabinet 10. Accordingly, the motor, pulleys, and belt to automatically move the door 30 vertically may also be arranged behind the front cover 15, such as inside the cabinet 10.

For example, a motor 66 and a lower pulley 71 driven by the motor 66 may be arranged at a lower portion of the cabinet 10 inside the cabinet 10, and an upper pulley 72 may be arranged at an upper portion of the cabinet 10 inside the cabinet 10. A belt 73 may be connected between the pulleys 71 and 72 to automatically move the door 30 along a generally vertical path, which is connected to the belt 73.

In the above-described drum washing machine according to the third embodiment of the present invention, when the automatic door opening button 61 or automatic door closing button 62 is actuated to automatically open or close the door 30, the motor 66 is driven, thereby causing the door 30 to move downwardly or upwardly. At that time, the rollers 47 mounted to the associated roller brackets 46 extending through the associated slits 15*a* roll along the associated vertical guides 41 in accordance with the vertical movement of the door 30. In such a case, the support rods 51 support the opening/closing operation of the door 30, similarly to the first embodiment, for example.

Thus, in the above-described drum washing machine according to the third embodiment of the present invention, the rollers 47, vertical guides 41, and belt 73 may be arranged inside the cabinet 10 without being outwardly exposed. Accordingly, the front surface of the drum washing machine may be kept attractive and clean.

Figure 11:
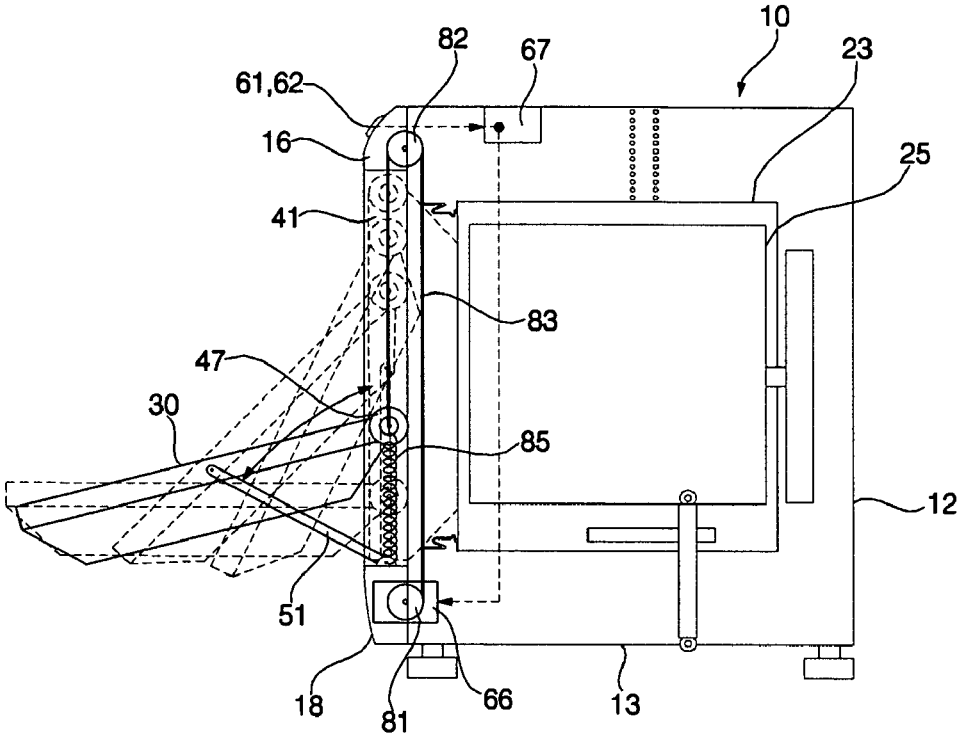
FIG. 11 is a schematic side view illustrating a drum washing machine according to a fourth embodiment of the present invention.

As shown in FIG. 11, for example, a drum washing machine according to a fourth embodiment of the present invention may use a winding roller 81, a dummy roller 82, and a rope 83, instead of the pulleys 71 and 72 and belt 73 described in the first embodiment.

For example, a motor 66 may be mounted to a lower portion of the cabinet 10 inside the cabinet 10. The winding roller 81 may be coupled to the motor 66 to wind or unwind the rope 83 while rotating in a forward or reverse direction in accordance with a drive force from the motor 66.

The dummy roller 82 may be rotatably mounted to an upper portion of the cabinet 10 inside the cabinet 10 to support the rope 83. The rope 83 may extend from the winding roller 81 to a roller 47 mounted to the door 30 via the dummy roller 82, and may be connected to the roller 47, for example.

Accordingly, when the motor 66 rotates in one direction, the rope 83 upwardly pulls the door 30 while being wound around the winding roller 81, thereby causing the door 30 to be automatically closed. On the other hand, when the motor 66 rotates in the other direction, the rope 83 wound around the winding roller 81 is unwound, thereby causing the door 30 to be downwardly moved, and thus, to be automatically opened.

The door 30 may be automatically opened due to the weight thereof. Alternatively, an elastic member 85 may be connected between the door 30 and the lower cover 18, as shown in FIG. 11, for example, to achieve the downward movement of the door 30, using the resilience of the elastic member 85. In such a case, for example, a lock (not shown) may be provided to prevent the door 30 from being unintentionally opened due to the resilience of the elastic member 85 when the door 30 is completely closed.

Although the automatic vertical movement of the door 30 may be achieved using the bi-directional motor 66 as an alternative, for example, the automatic vertical movement of the door 30 can also be achieved using a unidirectional motor to drive the motor only when the door 30 is to be closed. In such a case, the opening of the door 30 may be achieved by the resilience of the elastic member 85 when the locked state of the door 30 is released, for example.

Although the motor 66 has been described above as being mounted to the lower portion of the cabinet 10 inside the cabinet 10, alternatively, for example, the motor 66 may otherwise be installed at the upper portion of the cabinet 10 inside the cabinet 10, such as at a position corresponding to the dummy roller 82.

Figure 12:
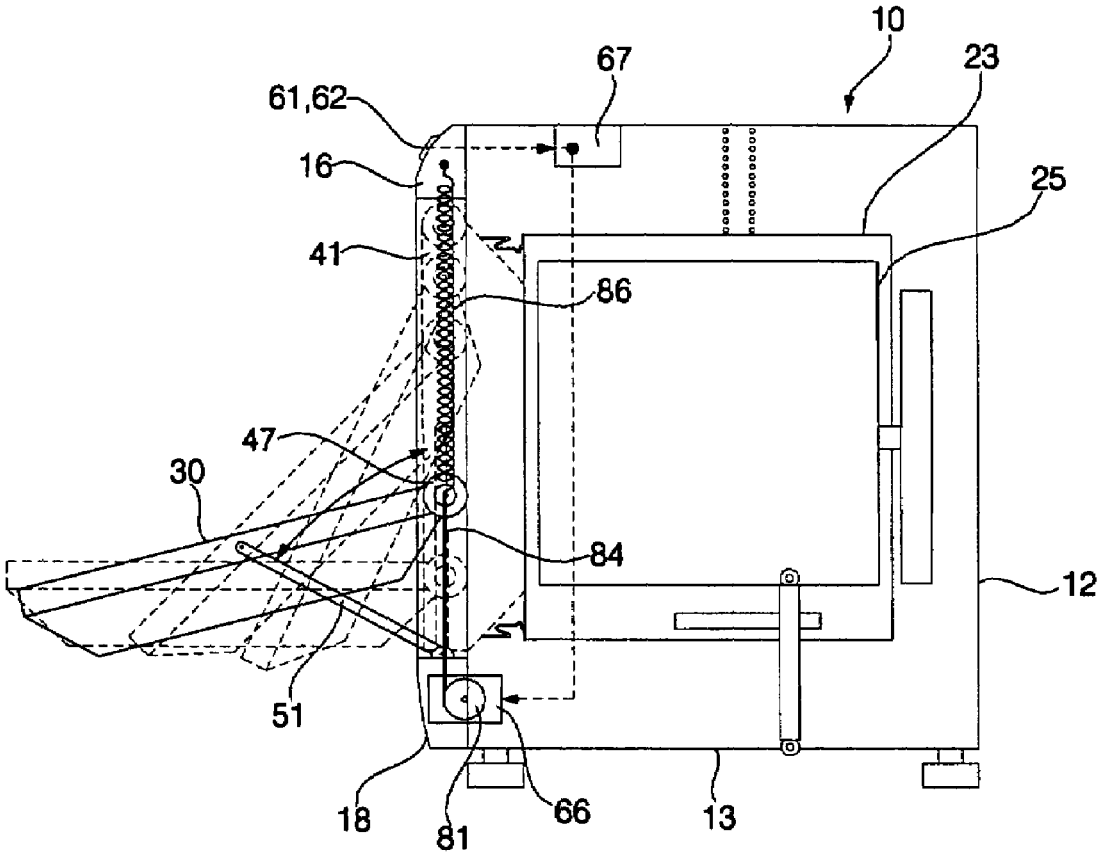
FIG. 12 is a schematic side view illustrating a drum washing machine according to a fifth embodiment of the present invention.

As shown in FIG. 12, for example, a drum washing machine according to a fifth embodiment of the present invention may have a door 30 which may be automatically opened in accordance with operation of a motor 66' and which may be automatically closed by an elastic member 86 in contrast to the fourth embodiment.

In such a case, the motor 66' may be a unidirectional motor. A winding roller 81 may be coupled to a shaft of the motor 66' and rope 84 may be connected between the winding roller 81 and a roller 47 mounted to the door 30. When the motor 66' is driven in a rope winding direction, for example, the rope 84 is wound around the winding roller 81, so that the door 30 is automatically opened.

For example, the elastic member 86 may be connected between an upper portion of the cabinet 10 and the door 30. Accordingly, when the driving force of the motor 66' is released, the door 30 may be automatically closed by the resilience of the elastic member 86.

Figure 13:
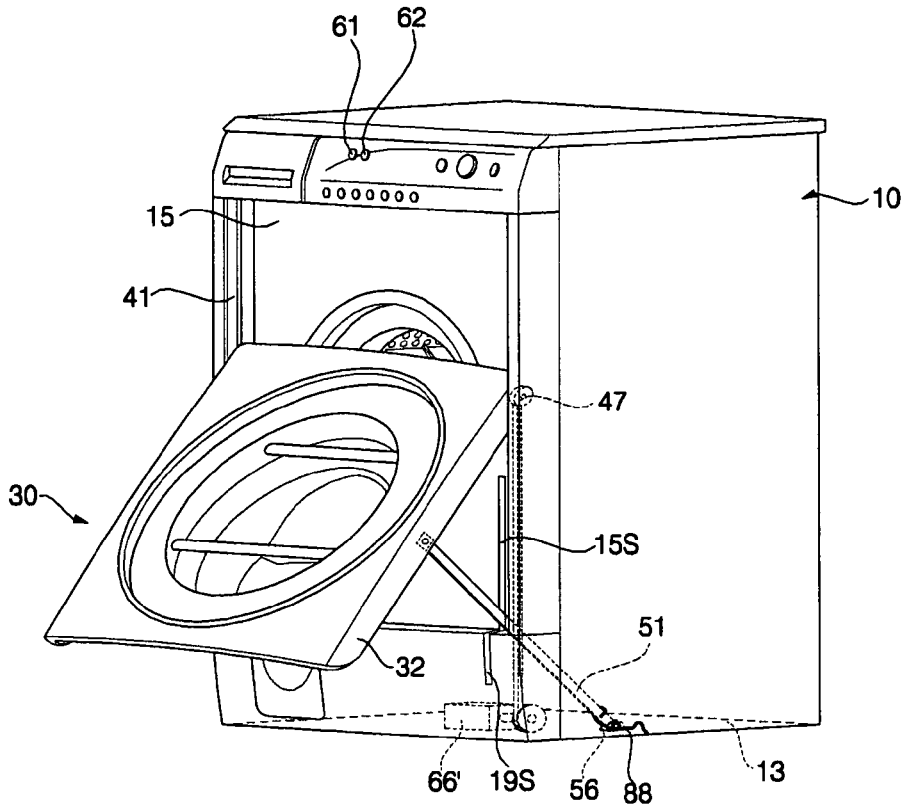
FIG. 13 is a perspective view illustrating a drum washing machine according to a sixth embodiment of the present invention, in which a door thereof is partially opened.
Figure 14:
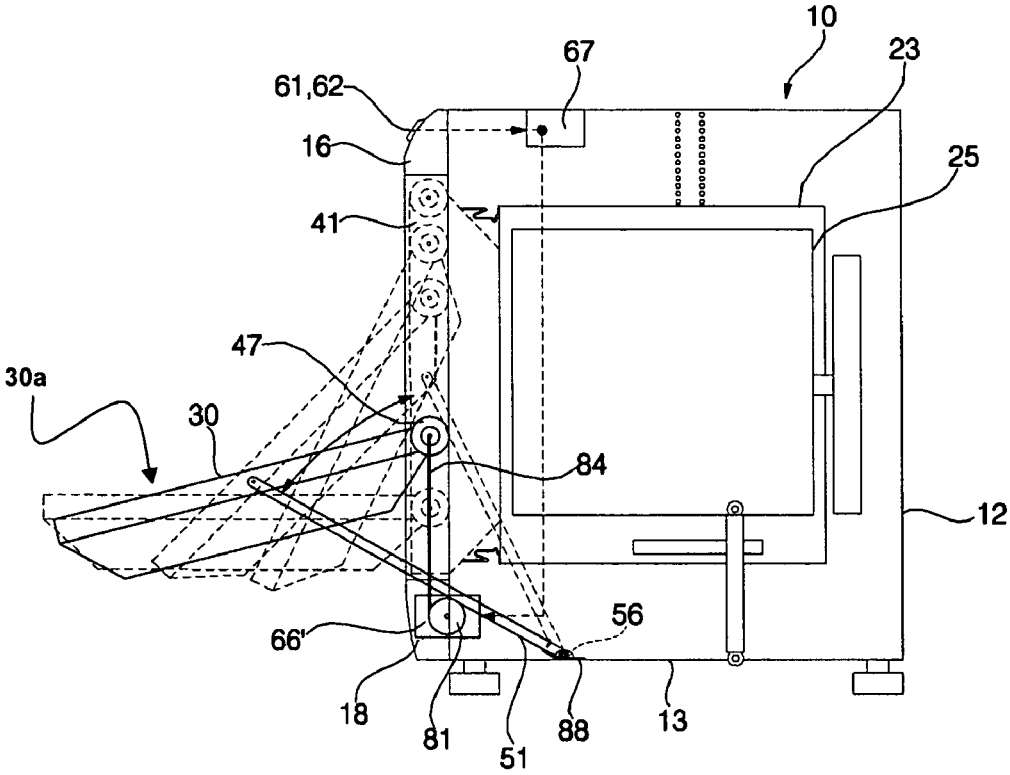
FIG. 14 is a schematic side view illustrating different positions of the door of the drum washing machine according to the sixth embodiment of the present invention, as the door opens or closes.

FIGS. 13 and 14 illustrate a drum washing machine according to a six embodiment of the present invention, for example, in which rollers 47 may be directly mounted to side portions 32 of a door 30, and support rods 51 may be mounted to a bottom wall of a cabinet 10.

For example, vertical guide plates 41 may be arranged at opposite side ends of an outer surface of a front cover 15, respectively, such that the outer surface of each vertical guide 41 is flush with the outer surface of the door 30. The door 30 may be arranged between the vertical guides 41 and the rollers 47 may be directly mounted to the associated side portions 32 of the door 30 at an upper end of the door 30, without necessarily using separate roller brackets, such that the rollers 47 are movable along the associated vertical guides 41, for example.

Each support rod 51 may have an upper end hingably connected to an associated one of the side portions 32 of the door 30, and a lower end extending into the cabinet 10 through the front cover 15 and a lower cover 19 and hingably connected to a base 13 forming the bottom wall of the cabinet 10.

A pair of hinge brackets 56 may be mounted to the base 13 to connect respective support rods 51 to the base 13. Vertically-elongated slits 15*s* and 19*s* may be formed at the front cover 15 and lower cover 19, respectively, so that the support rods 51 are freely movable while extending through the associated slits 15*s* and 19*s*.

For example, the door 30 may be automatically opened and/or closed similarly to the fifth embodiment, and the door 30 may be automatically opened as it is automatically moved downwardly as a rope 84 is wound around a winding roller 81 in accordance with the driving force of a motor 66', and may be automatically closed by the resilience of an elastic member 88.

In such a case, the elastic member 88 may be connected to a portion of each support rod 51 hingably connected to the cabinet 10 such that the elastic member 88 urges the support rod 51 to hinge upwardly, thereby causing the door 30 to be pushed upwardly, and thus, to be opened, as compared to the elastic member 86 of the fifth embodiment, for example.

The elastic member 88 may have a spiral spring structure, for example, and have one end connected to the support rod 51, and the other end connected to a hinge bracket 56, to which the associated support rod is hingably mounted.

The elastic member 88 is not necessarily limited to the spiral spring structure, and may alternatively have an elastic cord structure, a plate spring structure or a torsion spring structure, for example.

In the above-described drum washing machine according to the sixth embodiment of the present invention, the door 30 may be moved downwardly to be opened in accordance with the driving force of the motor 66', and may be moved upwardly to be closed from a horizontally opened state by the resilience of the elastic member 88 when the driving force of the motor 66' is released, for example.

The drum washing machine with the automatically vertically-openable/closable door 30 according to the present invention can allow the user to conveniently perform loading and/or unloading of laundry at either side of the drum washing machine because the door is vertically movable to be opened and/or closed, for example. Because the door can be completely opened even where the washing machine is installed in a limited or narrow space, there is an advantage in that the loading and/or unloading of laundry can be performed easily without any interference by the door.

Also, because the door window of the door may have a container-shaped structure, the door can be used as a laundry holder when the door is completely opened and maintained in a generally horizontal alignment, for example. Accordingly, it is possible to mitigate the problem of the user dropping laundry to the floor when taking the laundry out of the drum washing machine. Thus, improvement in the convenience of the drum washing machine for the user may be achieved.

Because the door may be automatically opened and/or closed in accordance with the present invention, the convenience of the drum washing machine for the user may be further improved.

Although several embodiments and examples of the present invention have been disclosed and described for illustrative purposes, those skilled in the art will appreciate that various modifications, additions, and/or substitutions thereto are possible, without departing from the spirit of the present invention, the scope of which is set forth in the accompanying claims.

What is claimed is:

1. A drum washing machine comprising:

a cabinet including an opening provided at a front wall of the cabinet, the opening configured to allow laundry to be put into or taken out of the cabinet;

a door configured to open or close the opening of the cabinet;

an opening/closing guide mechanism connected between the cabinet and the door and configured to guide the door downwardly when opening the door such that a front surface of the door is upwardly directed when the door is fully opened, and to guide the door upwardly when closing the door; and an automatic opening/closing mechanism configured to automatically move at least one end of the door along a generally vertical path, wherein the door is generally vertically openable or closable.

2. The drum washing machine according to claim 1, wherein the opening/closing guide mechanism comprises:

a vertical guide mechanism configured to guide an upper end of the door vertically along a front wall of the cabinet; and a door support mechanism configured to support the door when opening the door.

3. The drum washing machine according to claim 1, wherein the automatic opening/closing mechanism comprises:

an automatic opening/closing operating unit disposed on an outer surface of the cabinet and configured to generate a door opening signal or a door closing signal in response to an actuation of the automatic opening/closing operating unit by a user;

a rotating power generator configured to generate a drive power for a vertical movement of the door by an electrical power supplied in response to the actuation of the automatic opening/closing operating unit; and a power transmission configured to transmit the drive power generated by the rotating power generator to the door for the vertical movement of the door.

4. The drum washing machine according to claim 3, wherein the automatic opening/closing operating unit further comprises at least one of an automatic door opening operator or an automatic door closing operator.

5. The drum washing machine according to claim 3, wherein the rotating power generator comprises:

a motor disposed in the cabinet and configured to drive the power transmission; and a motor controller configured to control the motor in response to the actuation of the automatic opening/closing operating unit.

6. The drum washing machine according to claim 3, wherein the power transmission comprises:

a plurality of rotating members configured to be rotated by the rotating power generator, at least one of the rotating members being mounted to one of an upper portion or a lower portion of the door; and a linear member connected to the rotating members and configured to move linearly, the linear member having a portion connected to the door and configured to move the door generally vertically in accordance with the linear movement of the linear member.

7. The drum washing machine according to claim 5, further comprising:

a plurality of limit switches respectively disposed in a door opening path or a door closing path on the cabinet and configured to sense an opened position of the door or a closed position of the door.

8. The drum washing machine according to claim 6, wherein the opening/closing guide mechanism includes a vertical guide mechanism configured to guide an upper end of the door vertically along a front wall of the cabinet, wherein the vertical guide mechanism includes a plurality of vertical guides disposed at first and second opposite side portions of the cabinet extending vertically, respectively, and a plurality of guide couplers respectively protruding from first and second opposite side portions of the door, the guide couplers configured to move along the vertical guides along a generally vertical path, and wherein the linear member is connected to at least one of the guide couplers.

9. The drum washing machine according to claim 6, wherein the rotating members include a plurality of pulleys respectively mounted to an upper portion and a lower portion of the cabinet, and wherein the linear member includes a belt connected between the pulleys.

10. The drum washing machine according to claim 6, wherein the rotating members include a winding roller mounted to the cabinet, and wherein the linear member includes a rope connected between the winding roller and the door.

11. The drum washing machine according to claim 10, wherein the rotating members further comprise at least one dummy roller configured to support the rope connected between the winding roller and the door.

12. The drum washing machine according to claim 10, further comprising:

an elastic member disposed between the cabinet and the door, wherein the drive power generated by the rotating power generator causes a rotation in a first direction, and wherein the elastic member urges the door in a second direction opposite to the first direction.

13. The drum washing machine according to claim 12, wherein the opening/closing guide mechanism further includes a door support mechanism hingably connected to the cabinet and to the door at first and second opposite ends of the door support mechanism configured to support the door when opening the door, and wherein the elastic member is connected to a respective portion of each support rod mounted to the cabinet, configured to rotate the support rod by a resilience of the elastic member.

14. A drum washing machine comprising:

a cabinet including an opening provided at a front wall of the cabinet, the opening configured to allow laundry to be put into or taken out of the cabinet;

a door to open or close the opening of the cabinet;

a vertical guide mechanism connected between an upper end of the door and the cabinet and configured to guide the upper end of the door vertically along a front wall of the cabinet when opening or closing the door;

a door support mechanism connected between the door and the cabinet and configured to guide a lower end of the door generally horizontally when opening or closing the door; and an automatic opening/closing mechanism configured to automatically move the door along the vertical guide mechanism along a generally vertical path, wherein the door is generally vertically openable or closable.

15. The drum washing machine according to claim 14, wherein the automatic opening/closing mechanism comprises:

an automatic opening/closing operating unit disposed at an outer surface of the cabinet and configured to generate a door opening signal or a door closing signal in response to an actuation of the automatic opening/closing operating unit by a user;

a rotating power generator configured to generate a drive power for a vertical movement of the door by an electrical power supplied in response to the actuation of the automatic opening/closing operating unit; and a power transmission configured to transmit the drive power generated by the rotating power generator to the door for the vertical movement of the door.

16. The drum washing machine according to claim 15, wherein the rotating power generator comprises:

a motor disposed in the cabinet and configured to drive the power transmission; and a motor controller configured to control the motor in response to the actuation of the automatic opening/closing operating unit.

17. The drum washing machine according to claim 15, wherein the power transmission comprises:

a plurality of rotating members configured to be rotated by the rotating power generator, at least one of the rotating members being mounted to an upper portion or a lower portion of the door; and a linear member connected to the rotating members and configured to move linearly, the linear member having a portion connected to the door and configured to move the door generally vertically in accordance with the linear movement of the linear member.

18. The drum washing machine according to claim 17, wherein the rotating members include a plurality of pulleys respectively mounted to an upper portion or a lower portion of the cabinet, and wherein the linear member includes a belt connected between the pulleys.

19. The drum washing machine according to claim 17, wherein the rotating members include a winding roller mounted to the cabinet, and wherein the linear member includes a rope connected between the winding roller and the door.

20. The drum washing machine according to claim 19, further comprising:

an elastic member disposed between the cabinet and the door, wherein the drive power generated by the rotating power generator causes a rotation in a first direction, and wherein the elastic member urges the door in a second direction opposite to the first direction.

21. A washing machine for washing at least one item, comprising:

a cabinet including an opening provided at a front wall of the cabinet and configured to allow the item to be put into or taken out of the cabinet;

a door configured to open or close the opening of the cabinet;

an opening/closing guide mechanism connected between the cabinet and the door and configured to guide the door downwardly when opening the door such that a front surface of the door is upwardly directed when the door is fully opened, and to guide the door upwardly when closing the door; and an automatic opening/closing mechanism configured to automatically move at least one end of the door along a generally vertical path, wherein the door is generally vertically openable or closable.

22. The washing machine according to claim 21, wherein the opening/closing guide mechanism comprises:

a vertical guide mechanism configured to guide an upper end of the door vertically along a front wall of the cabinet; and a door support mechanism configured to support the door when opening the door.

23. The washing machine according to claim 21, wherein the automatic opening/closing mechanism comprises:

an automatic opening/closing operating unit disposed on an outer surface of the cabinet and configured to generate a door opening signal or a door closing signal in response to an actuation of the automatic opening/closing operating unit by a user;

a rotating power generator configured to generate a drive power for a vertical movement of the door by an electrical power supplied in response to the actuation of the automatic opening/closing operating unit; and a power transmission configured to transmit the drive power generated by the rotating power generator to the door for the vertical movement of the door.

24. A vertically openable door for opening or closing an opening at a front wall of a cabinet, the door comprising:

an opening/closing guide mechanism connected between the cabinet and the door and configured to guide the door downwardly when opening the door such that a front surface of the door is upwardly directed when the door is fully opened, and to guide the door upwardly when closing the door; and an automatic opening/closing mechanism configured to automatically move at least one end of the door along a generally vertical path.

25. The vertically openable door according to claim 24, wherein the opening/closing guide mechanism comprises:

a vertical guide mechanism configured to guide an upper end of the door vertically along a front wall of the cabinet; and a door support mechanism configured to support the door when opening the door.

26. The vertically openable door according to claim 24, wherein the automatic opening/closing mechanism comprises:

an automatic opening/closing operating unit disposed on an outer surface of the cabinet, configured to generate a door opening signal or a door closing signal in response to an actuation of the automatic opening/closing operating unit by a user;

a rotating power generator configured to generate a drive power for a vertical movement of the door by an electrical power supplied in response to the actuation of the automatic opening/closing operating unit; and a power transmission configured to transmit the drive power generated by the rotating power generator to the door for the vertical movement of the door.

27. A washing machine for washing at least one item, comprising:

a cabinet including an opening provided at a front wall of the cabinet and configured to allow the item to be put into or taken out of the cabinet;

a door configured to open or close the opening of the cabinet;

a vertical guide mechanism connected between an upper end of the door and the cabinet and configured to guide the upper end of the door vertically along a front wall of the cabinet when opening or closing the door;

a door support mechanism connected between the door and the cabinet and configured to guide a lower end of the door generally horizontally when opening or closing the door; and an automatic opening/closing mechanism configured to automatically move at least one end of the door along the vertical guide mechanism along a generally vertical path, wherein the door is generally vertically openable or closable.

28. The washing machine according to claim 27, wherein the automatic opening/closing mechanism comprises:

an automatic opening/closing operating unit disposed at an outer surface of the cabinet and configured to generate a door opening signal or a door closing signal in response to an actuation of the automatic opening/closing operating unit by a user;

a rotating power generator configured to generate a drive power for a vertical movement of the door by an electrical power supplied in response to the actuation of the automatic opening/closing operating unit; and a power transmission configured to transmit the drive power generated by the rotating power generator to the door for the vertical movement of the door.

29. A vertically openable door for opening or closing an opening at a front wall of a cabinet, the door comprising:

a vertical guide mechanism connected between an upper end of the door and the cabinet and configured to guide the upper end of the door vertically along a front wall of the cabinet when opening or closing the door;

a door support mechanism connected between the door and the cabinet, configured to guide a lower end of the door generally horizontally when opening or closing the door; and an automatic opening/closing mechanism configured to automatically move at least one end of the door along the vertical guide mechanism along a generally vertical path, wherein the door is generally vertically openable or closable.

30. The washing machine according to claim 29, wherein the automatic opening/closing mechanism comprises:

an automatic opening/closing operating unit disposed at an outer surface of the cabinet and configured to generate a door opening signal or a door closing signal in response to an actuation of the automatic opening/closing operating unit by a user;

a rotating power generator configured to generate a drive power for a vertical movement of the door by an electrical power supplied in response to the actuation of the automatic opening/closing operating unit; and a power transmission configured to transmit the drive power generated by the rotating power generator to the door for the vertical movement of the door.

* * * * *